United States Patent [19]

Dell'Anno

[11] 4,154,389

[45] May 15, 1979

[54] PET WASTE PAN AND DISPOSABLE BAG THEREFOR

[76] Inventor: Sal Dell'Anno, 165-16 65th Ave., Flushing, N.Y. 11365

[21] Appl. No.: 836,152

[22] Filed: Sep. 23, 1977

[51] Int. Cl.[2] ..... A01K 29/00; A47L 13/52; B65D 5/08

[52] U.S. Cl. ..... 229/38; 15/257.1; 294/1 R; 294/55

[58] Field of Search ..... 294/1 R, 19 R, 25, 55; 15/104.8, 257.1-257.9; 229/16 R, 37 R, 38

[56] References Cited

U.S. PATENT DOCUMENTS

| | | | |
|---|---|---|---|
| 2,799,442 | 7/1957 | Van Rosen | 229/37 R |
| 3,281,178 | 10/1966 | Fisher | 294/55 X |
| 3,765,044 | 10/1973 | Hanahan et al. | 15/104.8 |
| 3,827,098 | 8/1974 | Sanderson | 294/1 R X |
| 3,971,503 | 7/1976 | Allan et al. | 294/1 R X |
| 3,995,807 | 12/1976 | Dell'Anno | 294/1 R X |
| 4,047,746 | 9/1977 | Radowski | 294/55 |

*Primary Examiner*—Johnny D. Cherry
*Attorney, Agent, or Firm*—Kirschstein, Kirschstein, Ottinger & Cobrin

[57] ABSTRACT

The pan has a bag slipped thereon and projecting into the pan, so that pet waste on the street can be shoveled into the bag. Thereafter the bag can be slipped off the pan and disposed of, thereby permitting reuse of the pan. The pan has a bottom wall, side walls, a rear wall and top wall and is open at the front. The bottom of the bag projects into the pan through the front open end of the pan and the front open end of the bag is folded back to embrace bottom, side and top wall portions of the bag, while the closed end of the bag projects into the pan substantially to the inside of the bottom wall. The bag protects the pan so that pet waste can be shovelled into the bag without the waste touching the pan itself, thereby allowing reuse of the pan several times and allowing application of a fresh bag each time it is used.

3 Claims, 7 Drawing Figures

PET WASTE PAN AND DISPOSABLE BAG THEREFOR

This invention relates to devices for collecting waste from pets in the street.

An object of this invention is to generally improve the disposable pan shown in my U.S. Pat. No. 3,995,807, granted Dec. 7, 1976.

Another object of this invention is to provide a device of the character described comprising a pan onto which a disposable bag may be slipped, to receive the waste shovelled into the bag on the pan, thereby permitting disposal of the bag and waste it receives, and reuse of the pan.

Another object of this invention is to provide a device of the character described in which the pan is made of a single cardboard blank, and has a top wall, a rear wall, a bottom wall and side walls connecting the top and bottom walls, and which is so constructed that the closed end of a flexible sheet bag can be inserted into the pan through a front open end of the pan, and the front open end of the bag is folded back to receive portions of the top and bottom walls of the pan within the folded back portions of the bag, whereby pet waste can be shovelled into the bag, and the bag thereafter pulled off the pan and closed and disposed of, to permit a fresh bag to be slipped onto the pan which can be reused several times, the construction being such that pet waste can enter the bag without directly touching any part of the pan itself or soiling the pan.

Still another object of this invention is to provide a device of the character described having means for a user to hold the assembled pan and bag combination while the pet waste is readily shovelled into the bag fitted onto and into the pan.

Yet another object of this invention is to provide a device of the character described which shall be relatively inexpensive to manufacture, easy to manipulate, sanitary in use and which shall yet be practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

IN THE DRAWINGS

Figure 1:
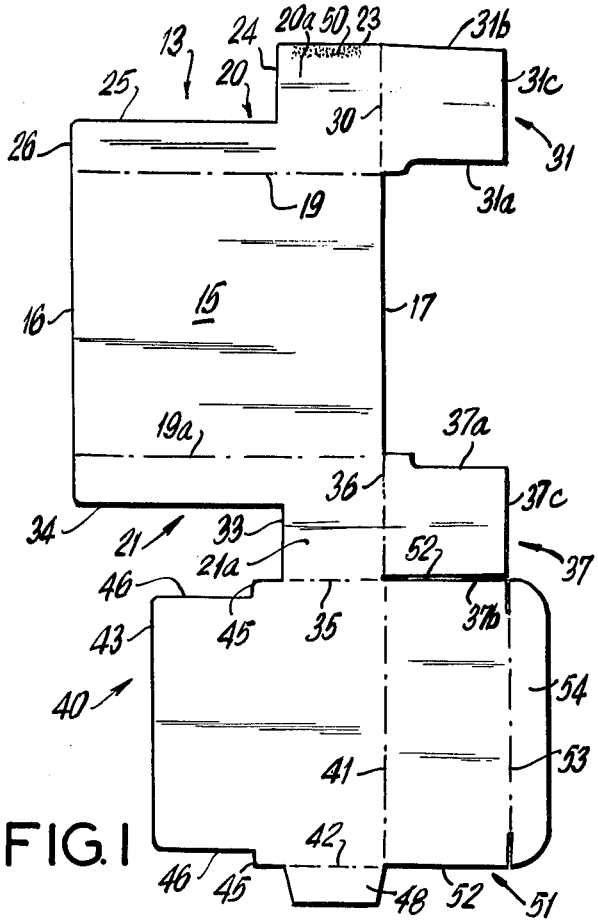
FIG. 1 is a top plan view of a blank from which the pan itself can be made.
Figure 3:
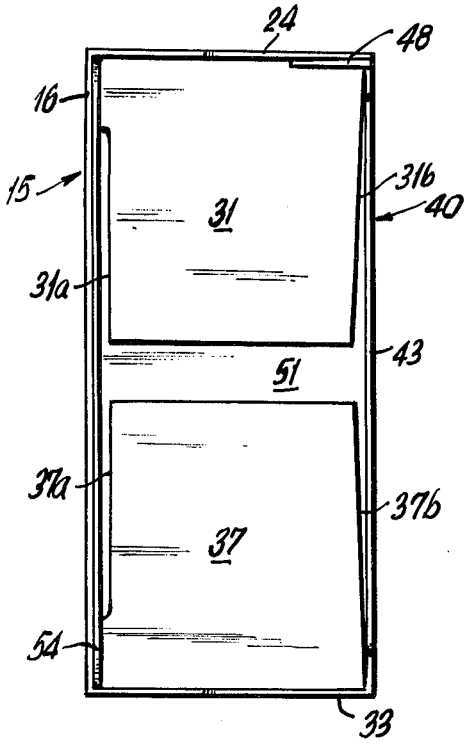
FIG. 3 is a front end view of the pan alone.
Figure 2:
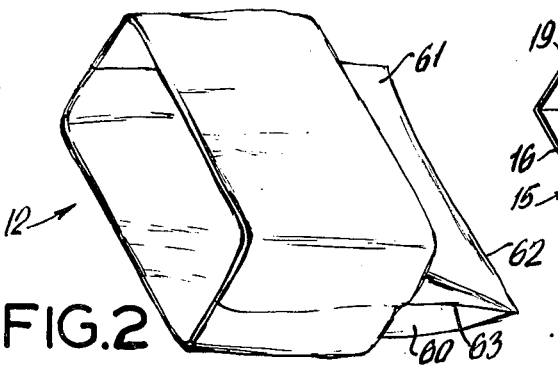
FIG. 2 is an exploded perspective view of the set up pan and bag illustrating how the bag can be fitted into the pan and onto the top and bottom walls thereof.
Figure 4:
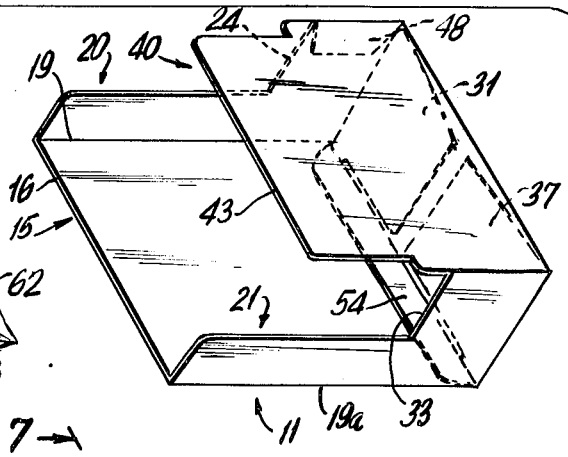
FIG. 4 is a perspective view of the pan with bag thereon and therein.
Figure 4:
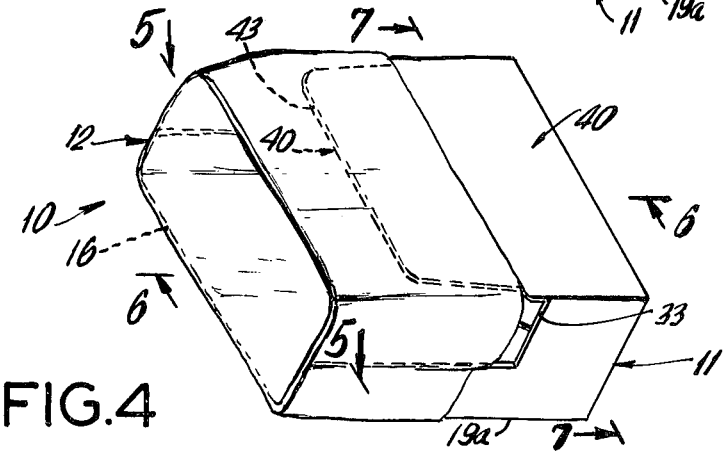
Figure 7:
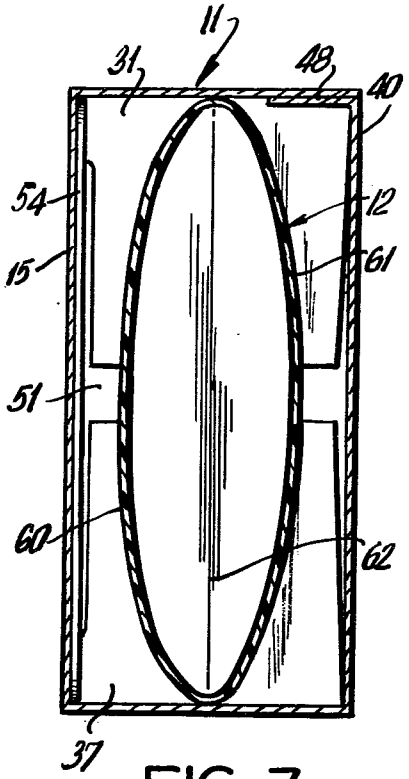
FIG. 7 is a cross-sectional view taken on line 7—7 of FIG. 4.
Figure 6:
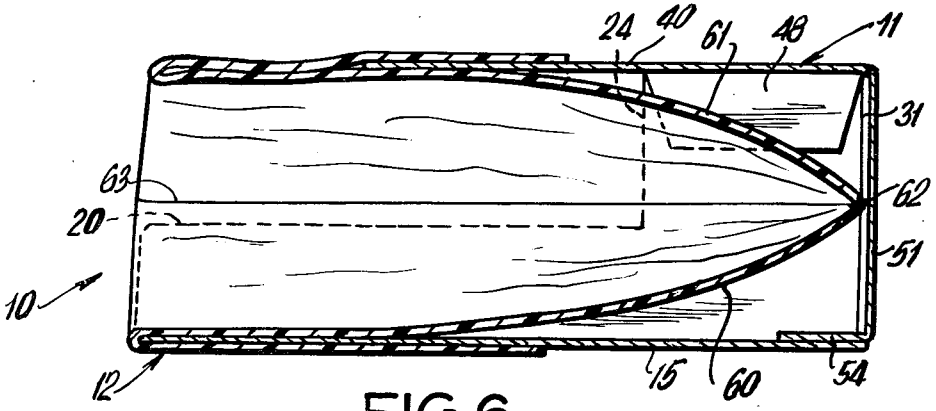
FIG. 6 is a cross-sectional view taken on line 6—6 of FIG. 4.
Figure 5:
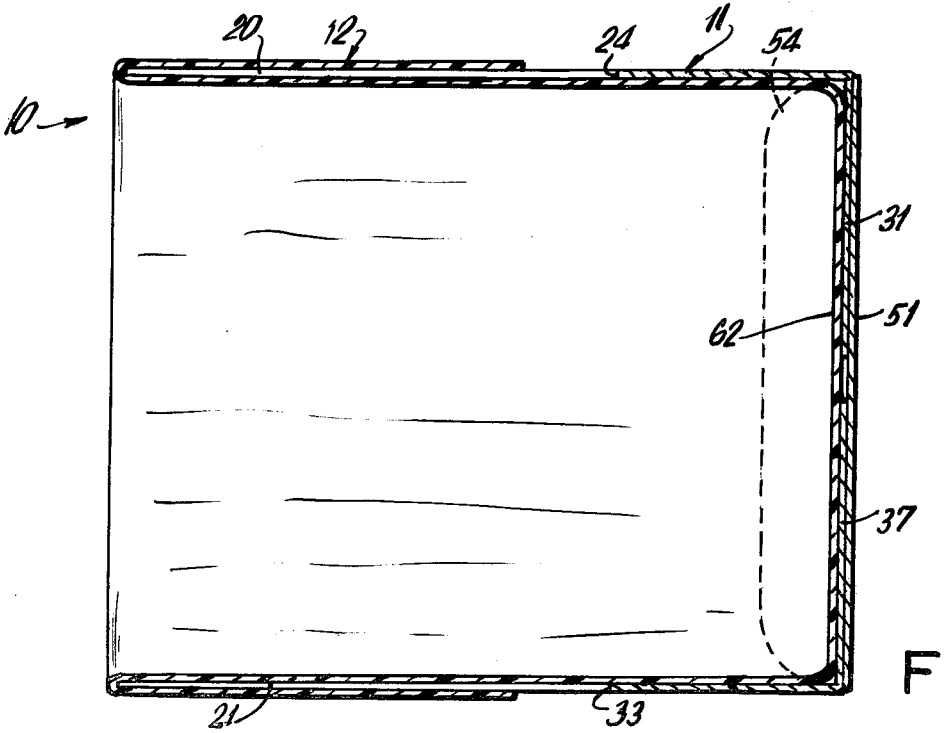
FIG. 5 is a cross-sectional view taken on line 5—5 of FIG. 4.

Referring now in detail to the drawing, numeral 10 designates an assembly embodying the invention and comprising a pan 11 onto which a flexible sheet bag 12 is fitted.

The pan 11 may be made from a single blank 13 of cardboard or the like stiff or semi-stiff material. Said blank 13 comprises a rectangular section 15 which will constitute the bottom wall of the pan 11 (when the device is set up). Section 15 has one end edge 16 which will be a front edge of the bottom wall when the pan is in use; and an opposite end edge 17 parallel to edge 16, which will constitute the rear edge of said bottom wall.

Extending from opposite sides of section 15 and foldable upwardly from said section, about parallel side fold lines 19, **19*a* are similar symmetrically disposed sections 20, 21 to constitute side walls of the set up pan. Said sections 20, 21 have rear portions 20*a*, 21*a* extending from fold lines 19, 19*a* respectively, the full height of the side walls of the pan, and located at the rear end of the bottom wall. Portion 20*a* has an upper edge 23, and an edge 24 at right angles to edge 23 and extending toward fold 19, but terminating short thereof. Extending from the lower end of edge 24, is an edge 25 running parallel to fold line 19. At the front end of edge 25 is an edge 26 which is a continuation of edge 16 (at one end of edge 16). At the rear end of section 20 is a fold line 30 in line with edge 17 and parallel to edge 24 and constituting the rear end of side section 20**.

Extending from fold line 30 is a section 31 which constitutes a flap for the purpose hereinafter appearing. This flap 31 is foldable to a position at right angles to section 20 and is in a vertical plane when the pan is in position of use. The inner side of section 31 is cut back somewhat, as shown at **31*a*. At its outer side, section 31 has an edge 31*b* in line with edge 23**.

Section 21 has an edge 33 similar and symmetrically disposed relative to edge 24, and an edge 34 similar and symmetrically disposed relative to edge 25.

At the outer side of section 21 is a fold line 35 which is the outer boundary of portion **21*a* of section 21. Fold line 35 is symmetrically disposed relative to edge 23 of portion 20*a* of section 20. At the rear end of section 21 is a fold line 36 in line with edge 17 and symmetrically disposed relative to fold line 30. Extending from fold line 36 is a section 37 which also constitutes a flap and is similar and symmetrically disposed to section 31**, for the purpose hereinafter appearing.

Flap 37 has an inner edge **37*a* similar and symmetrically disposed relative to 31*a*, and an outer edge 37*b* similar and symmetrically disposed relative to edge 31*b*. Flaps 31, 37 have outer edges 31*c*, 37*c*** respectively, which are similar and symmetrical.

Extending from fold line 35 of portion **21*a* of section 21 is a section 40 which constitutes the top wall of the pan 11. Section 40 has a rear fold line 41 in line with fold lines 36, 30 and rear edge 17 of section or top wall 15. Section 40, at its rear end, is as wide as section 15. At its outer side end, it has a fold line 42 similar and symmetrically disposed to fold line 35. Section 40 extends forwardly beyond fold lines 35, 42 but terminates short of the forward end of section 15. Thus, section 40 has a forward edge 43 parallel to edge 16 but closer to fold line 41 than edge 16 is to edge 17. The portion of section 40 which extends forwardly beyond fold lines 35, 42 has inwardly extending shoulders 45 and side edges 46 which are closer together than are fold lines 42, 35**.

Extending from fold line 42 is a tab 48 which is foldable at right angles to section 40 about fold line 42 to contact the inner surface of portion **20*a* of section 20 and is adhered thereto by adhesive in the area indicated by numeral 50. If desired the adhesive can be applied to the side of tab 48 not seen in FIG. 1** of the drawing.

Extending from fold line 41 is a section 51 which constitutes the rear wall of the pan. Section 51 has side edges 52 in line with fold lines 42 and 35, respectively. Thus, wall or section 51 is as long as section 40 is wide, between fold lines 42, 35. At the lower end of section 51 (as seen in FIG. 1) is a fold line 53 from which a narrow tab 54 extends.

To set up pan 11, sections 20, 21 are folded up from bottom section 15, and flaps 31, 37 are folded inwardly about fold lines 30, 36, respectively, to be in a vertical plane passing through edge 17, substantially. Section 40 is then folded down about fold line 35 to overlie section 15 in parallel spaced relation thereabove.

Tab 48 is folded down about fold line 42 to vertical position and adhered to the adhesive 50 at the inner surface of portion 20*a* of section 20.

Section 51 is folded down about fold line 41, to back up and lie against the flaps 31, 37, and tab 54 is folded to horizontal position about fold line 53 to lie against the top surface of section 15, adjacent edge 17, and beneath edges 31*a*, 37*a* of flaps 31, 37.

It will now be apparent that by the adherence of only tab 48 to section 20, the entire pan is held together in set up condition.

The tab 54 can be slipped in between the top section 15 and edges 31*a*, 37*a* of flaps 31, 37. Said flaps 31, 37 project toward each other in the set up pan, but do not touch or overlap.

It will be noted that shoulders 45 and edges 46 of top section 40 project forwardly beyond edges 24, 33 of sections 20, 21.

The bag 12 may be made of flexible plastic sheeting and comprises a bottom wall 60 connected to a top wall 61 by a rear fold line 62. The side edges of walls 60, 61 are fused together by side seams 63. Also the front ends of the bottom and top walls are folded back and the side seamed edges of the fold back walls are fused together at the side seams 63 to hold the folded back portions in folded back condition, thereby forming pockets at opposite sides of the bag. One pocket slips over sections 15, 20, 21, and the other pocket slips over section 40. Both pockets stop short of edges 24, 33, while the closed portion of the bag projects into the pan between the top, bottom and side walls of the pan, with the closed end of the bag substantially at flaps 31, 37 and rear wall 51 of the pan.

The pan is held in horizontal position with the wall 40 at the top and the wall 15 at the bottom. Pet's waste can be shovelled into the bag through the front open end of the bag, by a scraper, which can be a rectangular piece of cardboard. The portion of top wall 40 covered by the bag can be grasped by a hand of the user, after the waste is in the bag. The bag may be slipped off the pan, closed and disposed of, thereby allowing use of the pan several times.

In this manner, the overall cost of using means to remove pet's waste from the street, can be lessened.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

I claim:

1. A pan to receive waste made of a single blank of cardboard like material, said blank comprising a bottom section, side sections extending upwardly from said bottom section about fold lines at the sides of the bottom section, flaps extending from the rear ends of the side sections about fold lines at the rear ends of said side sections, said flaps projecting inwardly toward each other in a vertical plane, a top section extending about a fold line at the outer end of one of said side sections, and spaced above the bottom section in parallel relation thereto, a rear section extending vertically downwardly from the rear end of said top section against the outer sides of said flaps, a tab extending from the lower end of said rear section about a fold line and folded to lie on top of the bottom section, and below the lower edges of said flaps, and a tab extending from the rear of the outer end of said top section and lying against the inner surface of the other of said side walls and adhered thereto, said top and bottom sections being connected at their rear ends by rear portions of the side sections, said top and bottom sections extending forwardly beyond said rear portions of the side sections which connect said top and bottom sections, the front portion of the top section having free side edges and a free front edge, front portions of the side sections extending upwards from the bottom section and terminating below the top section.

2. The combination of claim 1, said side sections having front portions extending to the front ends of said bottom section and spaced from said top section.

3. The combination of claim 1, said bottom section extending forwardly further beyond said rear portions of said side sections, than said top section extends forwardly beyond said rear portions.

* * * * *